US010385878B2

(12) United States Patent
Arenella et al.

(10) Patent No.: US 10,385,878 B2
(45) Date of Patent: Aug. 20, 2019

(54) SOLENOID ACTUATED SAFETY COMPLIANT FAN FINGER GUARD STRUCTURES AND METHODS

(71) Applicant: International Business Machines Corporation, Armonk, NY (US)

(72) Inventors: Kenneth Arenella, Wappingers Falls, NY (US); Levi A. Campbell, Poughkeepsie, NY (US); Christopher R. Ciraulo, Wappingers Falls, NY (US); Robert K. Mullady, Highland, NY (US); Budy D. Notohardjono, Poughkeepsie, NY (US); Arkadiy O. Tsfasman, Wappingers Falls, NY (US); John S. Werner, Putnam Valley, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 251 days.

(21) Appl. No.: 15/611,905

(22) Filed: Jun. 2, 2017

(65) Prior Publication Data

US 2018/0347593 A1 Dec. 6, 2018

(51) Int. Cl.

| | |
|---|---|
| ***F04D 27/00*** | (2006.01) |
| ***F04D 29/70*** | (2006.01) |
| ***F04D 29/46*** | (2006.01) |

(52) U.S. Cl.

CPC ..... *F04D 29/703* (2013.01); *F04D 27/00* (2013.01); *F04D 29/464* (2013.01)

(58) Field of Classification Search

CPC ..... F04D 27/00; F04D 29/703; F04D 29/464; B41J 29/377

USPC ..... 416/121.2, 247 R, 227 R; 440/71, 72

See application file for complete search history.

(56) References Cited

U.S. PATENT DOCUMENTS

| | | | |
|---|---|---|---|
| 4,120,615 | A | 10/1978 | Keem et al. |
| 5,460,571 | A | 10/1995 | Kato et al. |
| 6,042,348 | A | 3/2000 | Aakalu et al. |
| 6,406,257 | B1 | 6/2002 | Houdek |
| 6,503,060 | B1 | 1/2003 | Kamada et al. |
| 6,775,137 | B2 | 8/2004 | Chu et al. |

(Continued)

FOREIGN PATENT DOCUMENTS

| | | |
|---|---|---|
| EP | 0 611 924 A1 | 8/1994 |
| JP | 1-314834 | 12/1989 |

(Continued)

OTHER PUBLICATIONS

List of IBM Patents or Patent Applications Treated as Related dated Jun. 2, 2017, 2 pages.

(Continued)

*Primary Examiner* — J. Todd Newton

(74) *Attorney, Agent, or Firm* — Scully, Scott, Murphy & Presser, P.C.; Tihon Poltavets

(57) ABSTRACT

A fan guard and method of use thereof. The fan guard includes a first lattice, a second lattice, a first solenoid operably connected to the second lattice, wherein the first solenoid is configured to move the second lattice relative to the first lattice from a first position to an alternate position and a second solenoid, the second solenoid configured to extend through a portion of the first lattice when the second lattice is in the alternate position.

18 Claims, 8 Drawing Sheets

(56) References Cited

U.S. PATENT DOCUMENTS

| | | | | |
|---|---|---|---|---|
| 7,118,333 | B2 | 10/2006 | Takemoto | |
| 7,667,966 | B2 | 2/2010 | Ong et al. | |
| 8,066,559 | B2 | 11/2011 | Cochrane | |
| 8,093,851 | B2 | 1/2012 | Yang et al. | |
| 8,388,423 | B2 | 3/2013 | Cruz et al. | |
| 8,936,443 | B2 | 1/2015 | Mashak et al. | |
| 9,137,930 | B2 | 9/2015 | Alshinnawi et al. | |
| 9,157,536 | B2 | 10/2015 | Li | |
| 9,383,117 | B2 | 7/2016 | Labrecque | |
| 2004/0197189 | A1 | 10/2004 | Seo et al. | |
| 2005/0095121 | A1 | 5/2005 | Vithani | |
| 2005/0168942 | A1 | 8/2005 | Steinbrecher et al. | |
| 2007/0110432 | A1* | 5/2007 | Viglione | G03B 9/22 396/465 |
| 2010/0189431 | A1* | 7/2010 | Viglione | G03B 9/22 396/463 |
| 2010/0244759 | A1 | 9/2010 | Makley et al. | |
| 2014/0187139 | A1 | 7/2014 | Zhong et al. | |
| 2015/0192219 | A1 | 7/2015 | Anderl et al. | |
| 2016/0095260 | A1 | 3/2016 | Campbell et al. | |
| 2016/0105996 | A1 | 4/2016 | Schanzenbach et al. | |
| 2016/0146223 | A1 | 5/2016 | Cao et al. | |
| 2016/0353951 | A1* | 12/2016 | Buchanan | F04D 25/08 |
| 2016/0356172 | A1 | 12/2016 | DiVincenzo et al. | |
| 2018/0347592 | A1* | 12/2018 | Arenella | F04D 25/166 |
| 2018/0347593 | A1* | 12/2018 | Arenella | F04D 27/00 |
| 2018/0347594 | A1* | 12/2018 | Arenella | F04D 25/14 |
| 2019/0047306 | A1* | 2/2019 | Sasaki | B41J 29/377 |

FOREIGN PATENT DOCUMENTS

| | | |
|---|---|---|
| JP | 4-203724 | 7/1992 |
| JP | 7-122870 | 5/1995 |
| JP | 7-324787 | 12/1995 |
| JP | 8-162790 | 6/1996 |
| WO | 03/042544 A1 | 5/2003 |
| WO | 2010/048730 A2 | 5/2010 |

OTHER PUBLICATIONS

Disclosed Anonymously, "Fan Guard Waiver", IPCOM000232276D, (3 pages) (Oct. 30, 2013).

Disclosed Anonymously, "Methods and Apparatus for Optimum Fan Operation While Maintaining High Safety Requirements", IPCOM000229498D, (5 pages) (Aug. 1, 2013).

U.S. Notice of Allowance dated Jan. 23, 2019 received in related U.S. Appl. No. 15/611,921.

U.S. Notice of Allowance dated Dec. 27, 2018 received in related U.S. Appl. No. 15/611,883.

* cited by examiner

SOLENOID ACTUATED SAFETY COMPLIANT FAN FINGER GUARD STRUCTURES AND METHODS

BACKGROUND

The present application relates to guard structures, and more particularly to a guard structure that complies with safety features and guards a fan.

Fans are used in conjunction with various electrical equipment that benefit from the movement of heat and/or air from their location. Perforations to cover the fan, thereby preventing a person from having their clothing or a portion of their bodies contact the blades of the fan, are a safety requirement. The specified dimensions for the size of perforations or openings are found in safety standards, such as International Electrotechnical Commission (IEC) 60950.

These safety standards include size of opening requirements for fan enclosures, which cover one or more surfaces of a fan.

During operation, fan enclosures with larger openings increase airflow and increase the ability of the fan to disperse heat because less material is blocking air flow from the fan. But, there is a limit as to how large the openings can be so as to still satisfy the safety requirements.

Thus, a guard structure for a fan that is safety compliant and also allows for increased air flow when the fan is in use is desired.

SUMMARY

In one embodiment, a fan guard is provided. The fan guard includes a first lattice, a second lattice, a first solenoid operably connected to the second lattice, wherein the first solenoid is configured to move the second lattice relative to the first lattice from a first position to an alternate position and a second solenoid, the second solenoid configured to extend through a portion of the first lattice when the second lattice is in the alternate position.

In another aspect of the present application a method of operating a fan guard is included. The method includes the steps of moving a second lattice relative to a first lattice, wherein a first solenoid is operably connected to the second lattice, wherein the first solenoid is configured to move the second lattice relative to the first lattice from a first position to an alternate position and extending a portion of a second solenoid through a portion of the first lattice.

DETAILED DESCRIPTION

Figure 1:
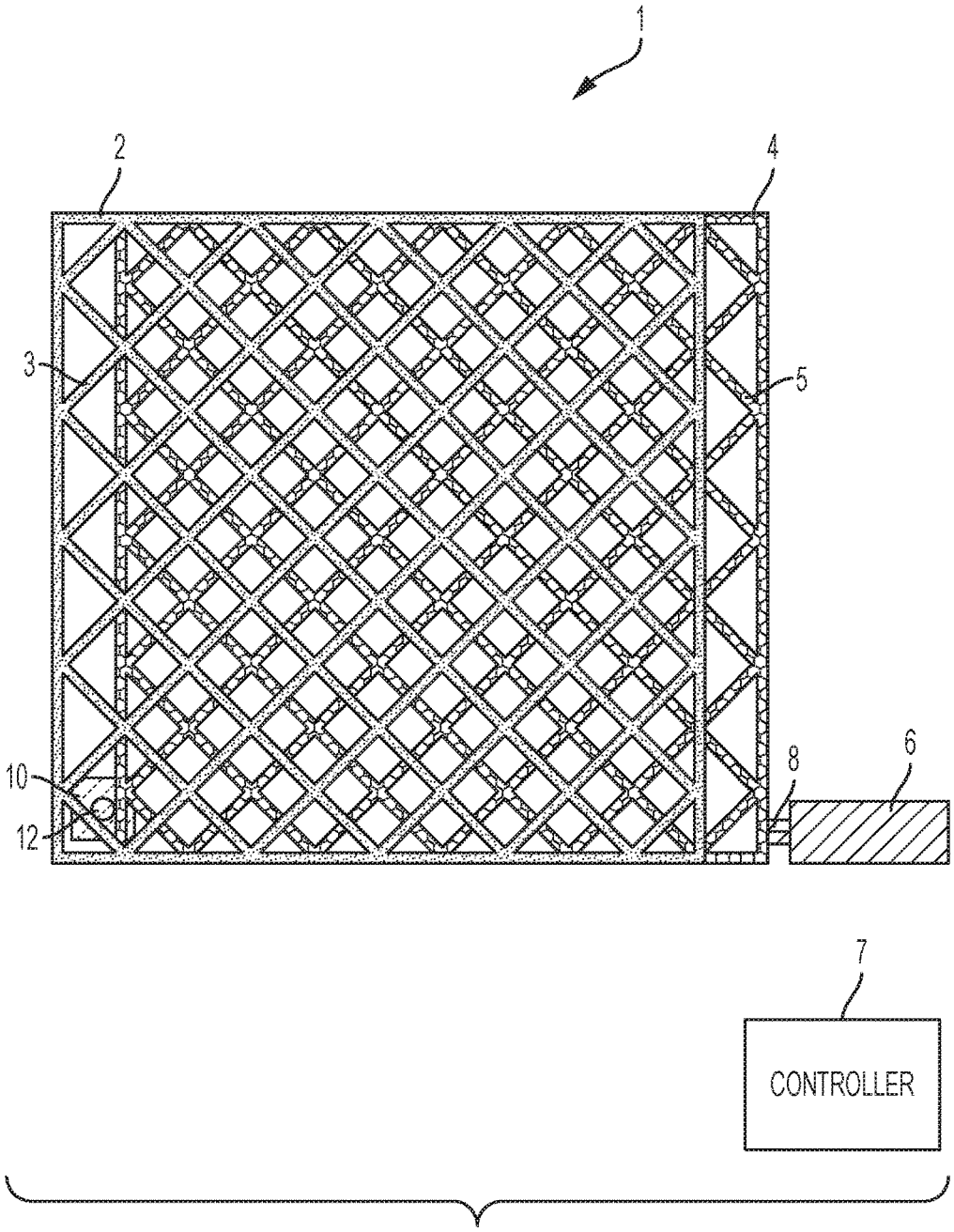
FIG. 1 is a front view of a fan guard of an embodiment of the application, in a first configuration.

The present application will now be described in greater detail by referring to the following discussion and drawings that accompany the present application. It is noted that the drawings of the present application are provided for illustrative purposes only and, as such, the drawings are not drawn to scale. It is also noted that like and corresponding elements are referred to by like reference numerals.

In the following description, numerous specific details are set forth, such as particular structures, components, materials, dimensions, processing steps and techniques, in order to provide an understanding of the various embodiments of the present application. However, it will be appreciated by one of ordinary skill in the art that the various embodiments of the present application may be practiced without these specific details. In other instances, well-known structures or processing steps have not been described in detail in order to avoid obscuring the present application.

It will be understood that when an element as a layer, region or substrate is referred to as being "on" or "over" another element, it can be directly on the other element or intervening elements may also be present. In contrast, when an element is referred to as being "directly on" or "directly over" another element, there are no intervening elements present. It will also be understood that when an element is referred to as being "beneath" or "under" another element, it can be directly beneath or under the other element, or intervening elements may be present. In contrast, when an element is referred to as being "directly beneath" or "directly under" another element, there are no intervening elements present.

In the discussion and claims herein, the term "about" indicates that the value listed may be somewhat altered, as long as the alteration does not result in nonconformance of the process or structure to the illustrated embodiment. For example, for some elements the term "about" can refer to a variation of ±0.1%, for other elements, the term "about" can refer to a variation of ±1% or ±10%, or any point therein.

As used herein, the term "substantially", or "substantial", is equally applicable when used in a negative connotation to refer to the complete or near complete lack of an action, characteristic, property, state, structure, item, or result. For example, a surface that is "substantially" flat would either be completely flat, or so nearly flat that the effect would be the same as if it were completely flat.

As used herein terms such as "a", "an" and "the" are not intended to refer to only a singular entity, but include the general class of which a specific example may be used for illustration.

As used herein, terms defined in the singular are intended to include those terms defined in the plural and vice versa.

Reference herein to any numerical range expressly includes each numerical value (including fractional numbers and whole numbers) encompassed by that range. To illustrate, reference herein to a range of "at least 50" or "at least about 50" includes whole numbers of 50, 51, 52, 53, 54, 55, 56, 57, 58, 59, 60, etc., and fractional numbers 50.1, 50.2 50.3, 50.4, 50.5, 50.6, 50.7, 50.8, 50.9, etc. In a further illustration, reference herein to a range of "less than 50" or "less than about 50" includes whole numbers 49, 48, 47, 46, 45, 44, 43, 42, 41, 40, etc., and fractional numbers 49.9, 49.8, 49.7, 49.6, 49.5, 49.4, 49.3, 49.2, 49.1, 49.0, etc. In yet another illustration, reference herein to a range of from "5 to 10" includes whole numbers of 5, 6, 7, 8, 9, and 10, and fractional numbers 5.1, 5.2, 5.3, 5.4, 5.5, 5.6, 5.7, 5.8, 5.9, etc.

As used herein the term "lattice" is used in a broad sense to refer to a mesh-like structure having one or more elements that extend across a frame to form a smaller opening, such as in a grate, a grid, a grill or a web of elements.

Referring first to FIG. 1, there is illustrated a general, front view of one embodiment of a fan guard 1. The fan guard 1 includes a first lattice 2 and a second lattice 4. First lattice 2 includes a number of first crosspieces 3, in a criss-cross pattern in this embodiment. Second lattice 4 includes a number of second crosspieces 5, in a criss-cross pattern in this embodiment. In other embodiments, the first crosspieces 3 and second crosspieces 5 can be the same, or different, and can be in any pattern that is suitable for the flow of air therethrough. The fan guard 1 can be placed in any suitable frame or structure to maintain the position of the fan guard 1 between a user and a rotating fan shaft, with blades attached thereto.

In this embodiment, the pattern of first crosspieces 3 and second crosspieces 5 remains substantially across the first lattice 2 and second lattice 4. In other embodiments, the pattern of first crosspieces 3 and second crosspieces 5 can change, such as by having a larger or smaller opening or a thicker or thinner crosspiece, across the first lattice and/or second lattice 4. One example of this embodiment is for the first crosspieces 3 to have smaller openings where the first lattice 2 does not overlap the second lattice 4 in FIG. 1, as compared to the openings of first crosspieces 3 in the remainder of the first lattice 2. As another example of this embodiment, the second crosspieces 5 can have smaller openings where the second lattice 4 is not overlapped by the first lattice 2 in FIG. 1, as compared to the openings of the second crosspieces 5 in the remainder of the second lattice 4.

The first lattice 2 and the second lattice 4 can be formed of the same, or different materials from each other. These materials can be any suitable material that can maintain a structural form, such as plastics, metals, carbon based materials, and mixtures thereof.

Also included in fan guard 1 is a first solenoid 6. First solenoid 6 is shown as a representative box with a first protrusion 8 that can be actuated to extend and retract by first solenoid 6 and is engageable with the second lattice 4 to extend and retract the lattice, but in other embodiments, any other solenoid or actuator that is capable of moving a lattice can be used. The first solenoid 6 is operably connected to the second lattice 4 and is actuated, such as by control signals, to move the second lattice 4 (shown in FIG. 1), relative to the first lattice 2, from a first position (shown in FIG. 3) to an alternate position, as shown in FIG. 1.

Also included in fan guard 1 is a second solenoid 10. Second solenoid 10 is shown as a representative box with a second protrusion 12 that can be actuated to extend and retract by a second solenoid 10, but in other embodiments, any other solenoid or actuator that is capable of extending a portion thereof through a lattice can be used. The second solenoid 10 is actuated, such as by control signals, so as to extend and withdraw the second protrusion 12 through a portion of the first lattice 2 when the second lattice 4 is in the alternate position, as shown in FIG. 1.

When the second lattice 4 is in the alternate position, as seen in FIG. 1, openings between both the first crosspieces 3 and openings between the second crosspieces 5 are smaller than or equal to the area proscribed in safety standards, such as IEC 60950, so as to not allow a person's finger to pass through both the first lattice 2 and the second lattice 4 to contact moving fan blades. In other embodiments the left side (as oriented in FIG. 1) of the first lattice 2 and the right side (as oriented in FIG. 1) of the second lattice 4 can include a different pattern of crosspieces, resulting in smaller openings, or can be substantially covered by a guard or plate to not allow access by a user.

Also included in fan guard 1, a controller 7 can be connected to both the first solenoid 6 and the second solenoid 10 wirelessly (as shown) or through a wired connection. The controller 7 is configured to send an electronic signal to each of the first solenoid 6 and the second solenoid 10 to extend and retract their respective protrusions. As used herein, the term "controller" can be any type of controller or processor, and may be embodied as one or more controllers, configured, designed, programmed, or otherwise adapted to perform the functionality discussed herein. As the term controller or processor is used herein, a controller or processor may include use of a single integrated circuit ("IC"), or may include use of a plurality of integrated circuits or other components connected, arranged, or grouped together, such as controllers, microprocessors, digital signal processors ("DSPs"), parallel processors, multiple core processors, custom ICs, application specific integrated circuits ("ASICs"), field programmable gate arrays ("FPGAs"), adaptive computing ICs, associated memory (such as RAM, DRAM and ROM), and other ICs and components. As a consequence, as used herein, the term controller (or processor) should be understood to equivalently mean and include a single IC, or arrangement of custom ICs, ASICs, processors, microprocessors, controllers, FPGAs, adaptive computing ICs, or some other grouping of integrated circuits which perform the functions discussed below, with associated memory, such as microprocessor memory or additional RAM, DRAM, SDRAM, SRAM, MRAM, ROM, FLASH, EPROM or EEPROM. A controller (or processor) (such as controller 7), with its associated memory, may be adapted or configured (via programming, FPGA interconnection, or hard-wiring) to perform the methodology, as discussed below in reference to FIG. 5. Although controller 7 is arranged in a single housing, it is contemplated that various components of the controller 7 could have separate housings.

Figure 2:
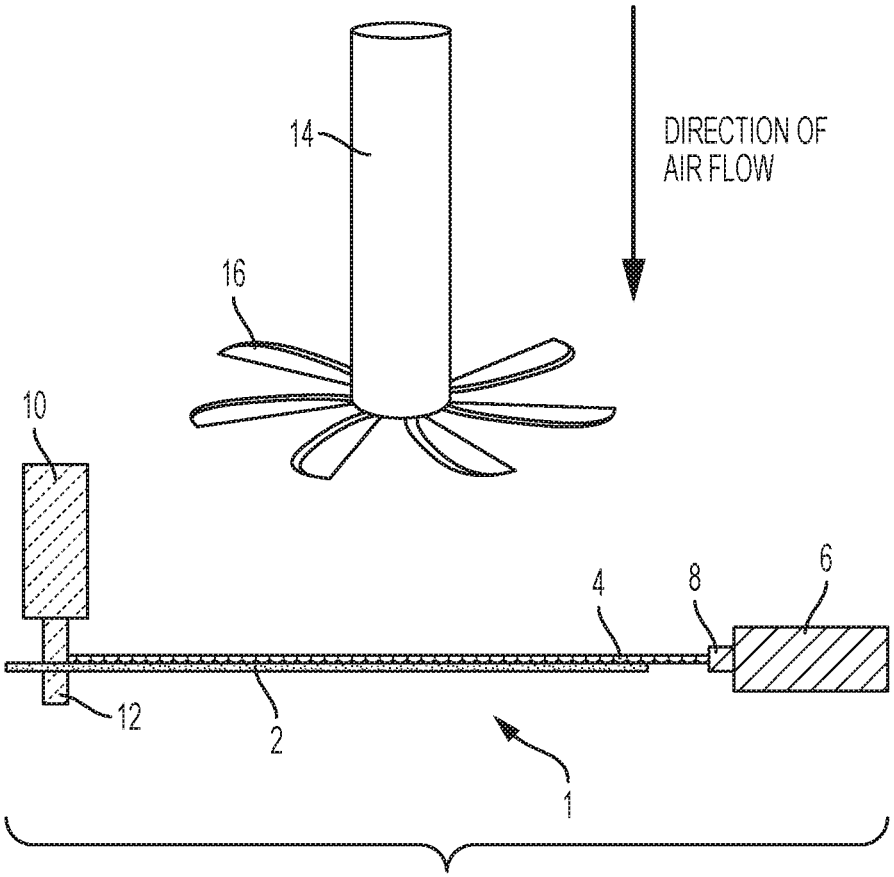
FIG. 2 is a top view of a fan guard of an embodiment of the application, in a first configuration.

Referring first to FIG. 2, there is illustrated a general, top view of one embodiment of the fan guard 1, the front view of which is shown in FIG. 1. As can be seen second protrusion 12 is extended through a portion of the first lattice 2, in an extended position. In this embodiment an edge of second lattice 4 contacts and abuts the second protrusion 12, but in other embodiments there can be a space between the second lattice 4 and the second protrusion 12. In other embodiments, the second protrusion 12 can extend through a portion 2 to prevent movement of the first lattice 2 relative to the second lattice 4. This second protrusion 12 prevents a user from manually moving the second lattice 4 with either their hands or with a tool.

In this view it can be seen that first protrusion 8 is in a withdrawn position. A fan shaft 14 and fan blades 16 are shown for illustrative purposes and are not limited to the size, orientation or location they are shown in. Also for illustrative purposes an arrow indicating the flow of air from the fan blades 16 is shown as being directed towards the first lattice 2 and second lattice 4. In other embodiments, the flow of air can be in the opposite direction, or at any angle that passes air through the first lattice 2 and the second lattice 4.

Also as can be seen in FIG. 2, the second solenoid 10 is oriented substantially perpendicular to both the first lattice 2 and the second lattice 4, but in other embodiments, second solenoid 10 can be at any suitable angle with respect to the first lattice 2 and the second lattice 4. Also as can be seen in FIG. 2, the first solenoid 6 is substantially parallel to both first lattice 2 and second lattice 4, but in other embodiments, first solenoid 6 can be at any suitable angle with respect to the first lattice 2 and the second lattice 4.

Figure 3:
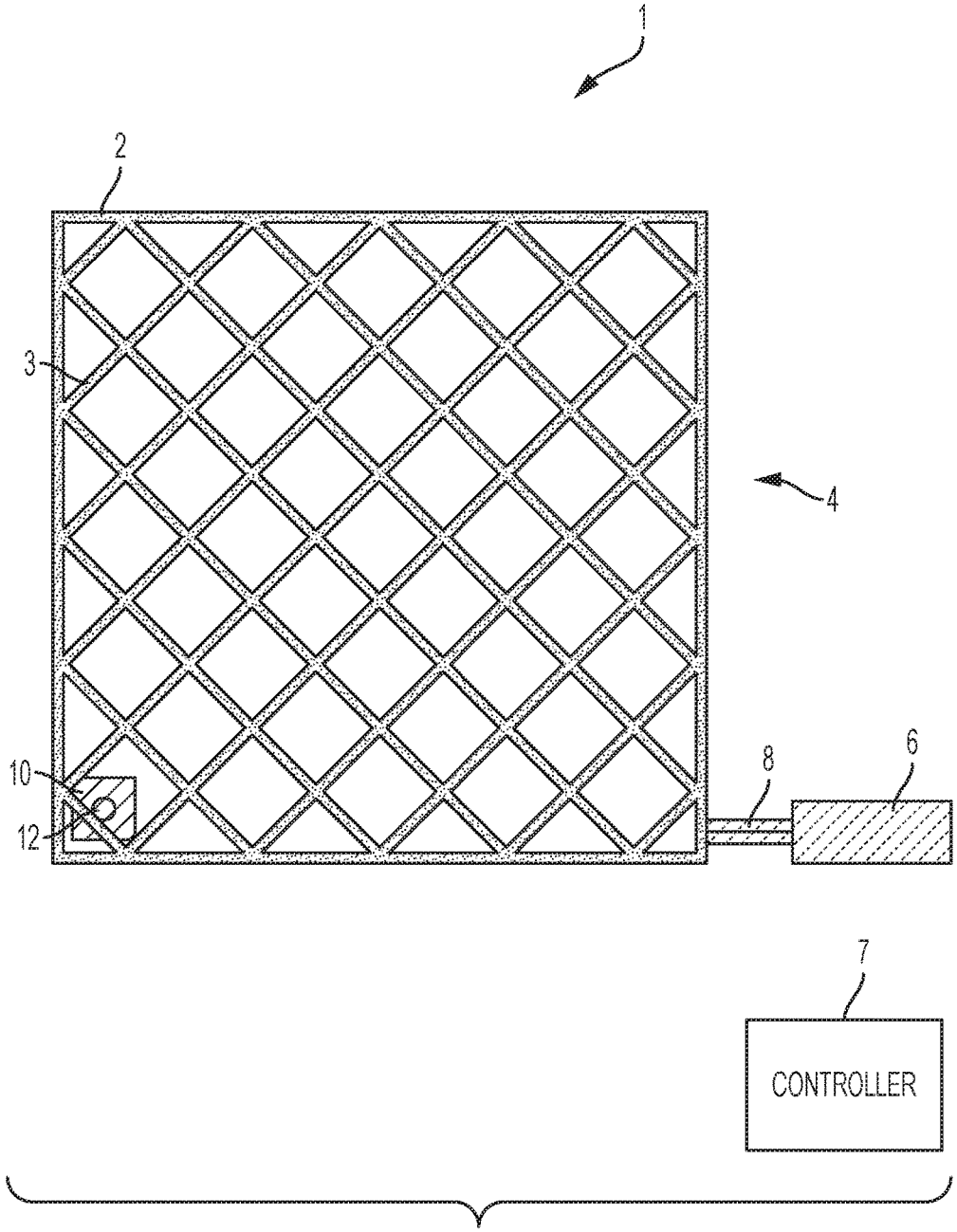
FIG. 3 is a front view of a fan guard of an embodiment of the application, in an alternate configuration.

Referring first to FIG. 3, there is illustrated a general, front view of one embodiment of a fan guard 1, with the second lattice 4 (better seen in FIG. 4) being in a first position. In this view, second lattice 4 is extended to a position directly behind the first lattice 2 and hidden from view. In this view, first crosspieces 3 of the first lattice 2 substantially align with second crosspieces 5 of the second lattice 4. The positional change between FIGS. 1 and 3, between the alternate position and the first position, is shown and described as a positional change along the X-Y axis, but in other embodiments, this positional change can be due to any lateral movement along any plane.

Transitioning from the alternate position of FIG. 1 to the first position in FIG. 3, the second solenoid is configured to withdraw the second protrusion 12 through a portion of the first lattice 2 and the first solenoid 6 is configured to extend first protrusion 8 so as to move the second lattice 4 into the position of FIG. 3.

When the second lattice 4 is in the first position, as seen in FIG. 3, the openings between both the first crosspieces 3 and openings between the second crosspieces 5 are larger than the area proscribed in safety standards such as IEC 60950, so as to allow a larger flow of air to pass through both the first lattice 2 and the second lattice 4.

Figure 4:
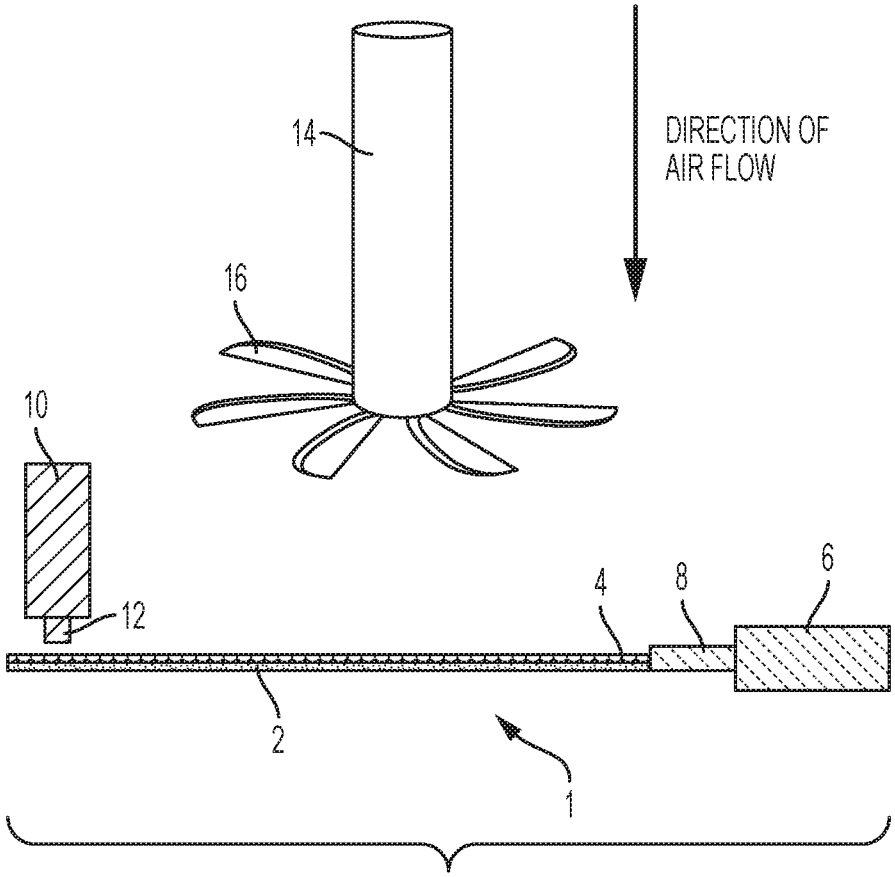
FIG. 4 is a top view of a fan guard of an embodiment of the application, in an alternate configuration.

Referring first to FIG. 4, there is illustrated a general, top view of one embodiment of the fan guard 1, the front view of which is shown in FIG. 3. As can be seen, second protrusion 12 is withdrawn from the first lattice 2 thereby permitting extension of the solenoid protrusion 8 and second lattice 4 to the overlapped position shown. In this view it can be seen that the first protrusion 8 has been extended from the first solenoid 6. In other embodiments, the flow of air can be in the opposite direction, or at any angle that passes air through the first lattice 2 and the second lattice 4. In this view, and in FIG. 3, no door, cover and/or bezel is shown as covering either lattice, but in other embodiments, the fan guard 1 can include one or more of a door, cover and bezel that separates either lattice from an area accessible by a user.

Figure 5:
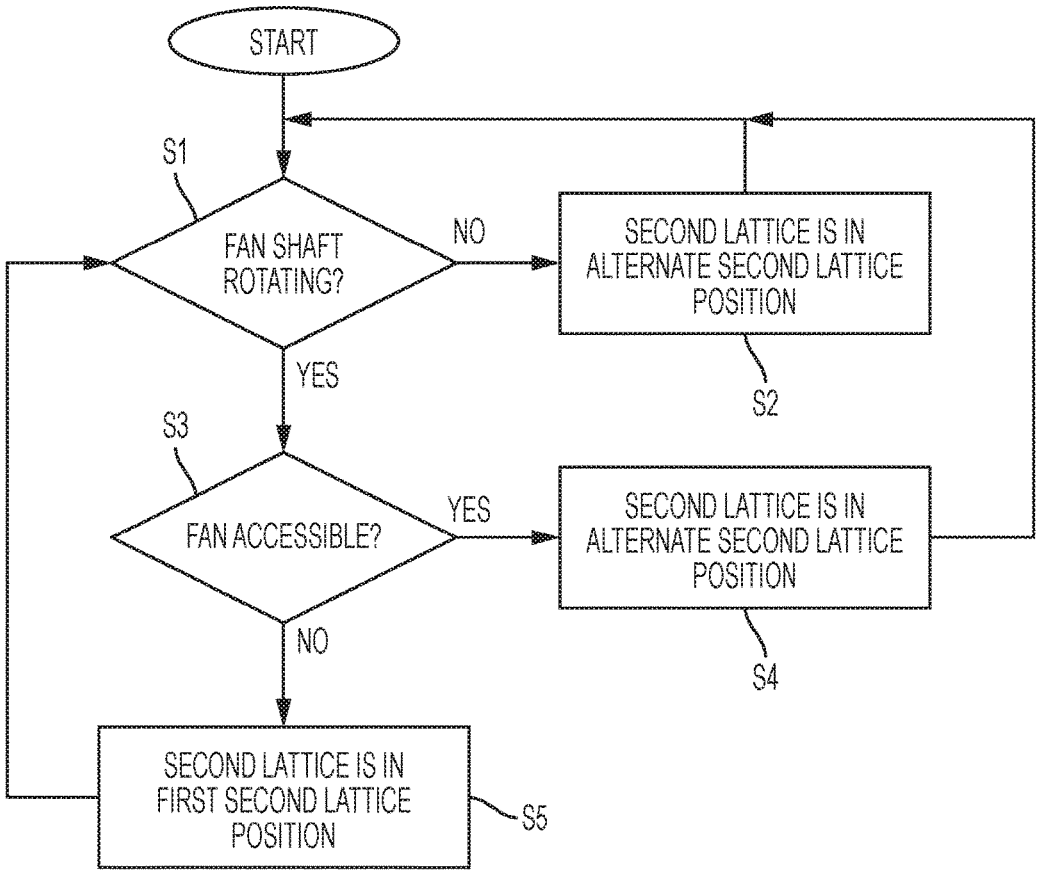
FIG. 5 is a flow chart of one embodiment of the application.

A flow chart illustrating a method of the present application is shown in FIG. 5. Although this flow chart refers to a single fan shaft rotating, two or more fan shafts, with their respective fan guards, can be controlled according to the discussed method. Controller 7, shown in FIGS. 1 and 3, and discussed above, effects the movements of both solenoids and the second lattice 4, as discussed below. Controller 7 can be programmed, using software and data structures, for example, to perform the methodology described below.

At the start, step S1 determines whether or not a fan shaft 14 is rotating. If the fan shaft 14 is not rotating at S1, the second lattice 4 is in the alternate position at step S2, as shown in FIG. 1. If the fan shaft 14 is not rotating at S1 and the second lattice 4 is not in the alternate position at S2, the first solenoid 6 and second solenoid 10 operate as discussed above to place the second lattice 4 in the alternate position. After S2, the method loops back to S1.

Figure 6:
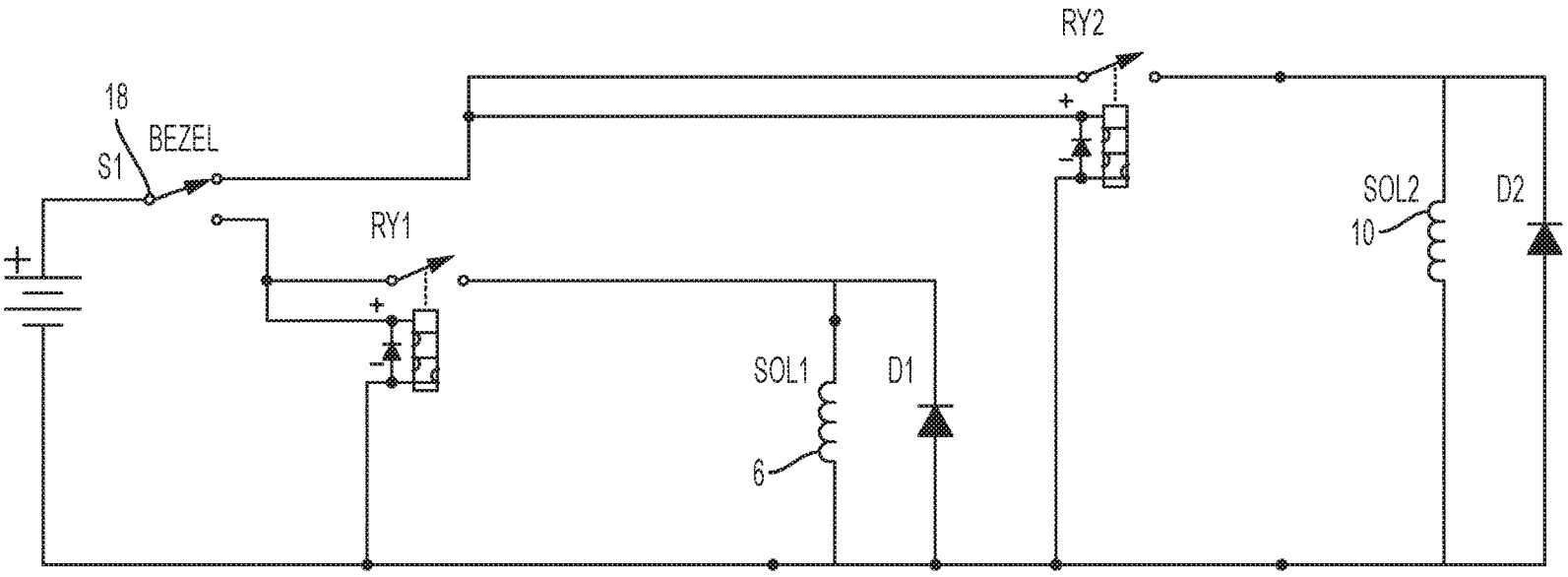
FIG. 6 is a circuit diagram of one embodiment of the application.

If the fan shaft 14 is rotating in S1, the method proceeds to determine whether or not the fan shaft 14 and/or the fan blades 16 are accessible by a user at step S3. Accessible can mean that an external cover other than the fan guard 1 has been opened by a user. It can be detected at step S3 whether or not the fan shaft 14 and/or the fan blades 16 are accessible by a user if (a) a switch is changed to an off position, such as by removal of an external cover, opening of a door, or removal of a bezel and/or (b) a sensor determines if an external cover is removed, a door has been opened, or a bezel has been removed. A switch 18 is shown in FIG. 6, discussed below. In FIG. 5, the controller 7 can receive a signal from the switch in step S3 to detect whether or not the fan shaft 14 and/or the fan blades 16 are accessible by a user.

If at step S3 the fan is accessible and the second lattice 4 is already in the alternate position, as shown in FIG. 1, flow continues to step S4 with no movement of the second lattice 4 or solenoids 6 and 10. If the fan shaft 14 and/or the fan blades 16 are accessible at S3 and the second lattice 4 is not in the alternate position at S4, the first solenoid 6 and second solenoid 10 operate as discussed above to place the second lattice 4 in the alternate position. After S4, the method loops back to S1.

If at step S3 the fan is not accessible, meaning that the fan is behind a door, cover, or bezel, the second lattice 4 is in the first position behind lattice 2 at step S5. If the fan shaft 14 and/or the fan blades 16 are not accessible at S3 and the second lattice 4 is not in the first position at S4, the first solenoid 6 and second solenoid 10 operate as discussed above to place the second lattice 4 in the first position. After S5, the method loops back to S1.

In steps S2 or S4, so that the second lattice 4 is in the alternate position, the method can include moving the second lattice 4 relative to the first lattice 2. To effect this movement, the first solenoid 6 is operably connected to the second lattice 4 and the first solenoid 6 is configured to move the second lattice 4 relative to the first lattice 2 from a first position (shown in FIG. 3) to an alternate position (shown in FIG. 1). After this movement, the second protrusion 12 of the second solenoid 10 is controlled to extend through a portion of the first lattice 2 (as shown in FIG. 2). To ensure that the second lattice 4 has moved to the position shown in FIG. 2, back Electromotive force (EMF) can be monitored and/or additional switches and/or sensors can be included to ensure the location of the second lattice 4.

The second protrusion 12 of the second solenoid 10 can extend through a portion of the first lattice 2 upon movement of the first protrusion 8 of the first solenoid 6, or second protrusion 12 can wait a predetermined amount of time after movement of the first protrusion 8 to extend through a portion of the first lattice 2. This predetermined amount of time can be an amount of time that is sufficient for first solenoid 6 to move the second lattice 4 from the first position to the alternate position and can be stored and controlled by controller 7.

If the method proceeds from step S5, through step S1 to either step S2 or S4, the method can also include a step of withdrawing the first protrusion 8 of the first solenoid 6 and moving the second lattice 4 from the first position (FIG. 3) to the alternate position (FIG. 1), followed by extending the second protrusion 12 of second solenoid 10 through a portion of the first lattice 2.

The first protrusion 8 of the first solenoid 6 can move the second lattice 4 upon movement of the second protrusion 12 of the second solenoid being withdrawn, or the first protrusion 8 can wait a predetermined amount of time after movement of the second protrusion to move the second lattice 4. This predetermined amount of time can be an amount of time that is sufficient for second solenoid 10 to withdraw the second protrusion 12 fully from a portion of the first lattice 2 and can be stored and controlled by controller 7.

FIG. 6 illustrates one embodiment of a circuit diagram of the present disclosure. As can be seen the first solenoid 6 can include a delayed relay (RY1), which can account for the time it takes protrusion 12 to withdraw from extending through or withdrawing from the first lattice 2. The second solenoid 10 can also include a delayed relay (RY2), which can account for the time it takes protrusion 8 to move the second lattice 4. These delayed relays can be used in the method described in FIG. 5 as waiting the predetermined amount of time in steps S2 and S4. A switch 18 can be activated and deactivated by removal and replacement of, in this embodiment, a bezel, but in other embodiments any suitable cover or door.

Although switch 18 is shown in FIG. 6 as interacting with two solenoids, and thus one fan, in other embodiments, switch 18 can be configured to interact with one or more additional solenoids and one or more additional fans. In these embodiments the switch 18 can cause the movement of one or more lattices in order to reduce opening size between crosspieces of those lattices once a door, bezel or cover is removed. In these embodiments, switch 18 can optionally be replaced by a suitable sensor, such as an optical sensor, a light sensor and a pressure sensor, which are configured to detect removal of a bezel/door/cover.

The methods and devices of the present disclosure will be better understood by reference to the following examples, which are provided as exemplary of the disclosure and not by way of limitation.

EXAMPLE 1

When fan guard 1 is in the alternate position, as shown in FIG. 1, the square areas formed by the openings of both the first lattice 2 and the second lattice 4 (white areas between the crosspieces of both the first lattice 2 and the second lattice 4) are about 4.39 mm per side. Therefore, the open area between the edge of the first lattice 2 furthest from the second solenoid 10 and the solenoid 10 has an open area of about 3,469 $mm^2$.

When fan guard 1 is in the first position, as shown in FIG. 3, the square areas formed by the openings of both the first lattice 2 and the second lattice 4 (white areas between the crosspieces of the first lattice 2) are about 10 mm per side. Therefore, the open area between the edge of the first lattice 2 furthest from the second solenoid 10 and the second solenoid 10 has an open area of about 4,500 $mm^2$.

To determine the difference in pressure drop between the two second lattice positions, the following formulas were used:

$$\Delta p = \frac{k\rho}{2}v^2$$

Wherein p is pressure, k is the minor loss coefficient, ρ is the air density and v is air velocity. k Next, the following equations were solved to determine the difference in pressure drop of air passing through the open area shown in FIG. 1 ($A_1$) as compared to the air passing through the open area shown in FIG. 3 ($A_2$).

$$v = \frac{\dot{V}}{A}\Delta p = \frac{k\rho}{2}\left(\frac{\dot{V}}{A}\right)^2$$

-continued $$\frac{\Delta p_1}{\Delta p_2} = \frac{A_2^2}{A_1^2}$$

$$\frac{\Delta p_1}{\Delta p_2} = \frac{(3469\ mm^2)^2}{(4500\ mm^2)^2} = 0.594$$

Wherein $\dot{V}$ is constant volume flow and A is area.

As can be seen, the pressure drop of air passing through the open area shown in FIG. 1 ($A_1$) as compared to the air passing through the open area shown in FIG. 3 ($A_2$) is about 59.4%. This pressure drop is indicative of an increased airflow when the second lattice 4 of fan guard 1 is in the first position shown in FIG. 3. Due to an increased air flow fan speeds can be decreased to achieve a similar air flow to the flow when the second lattice 4 is in the alternate position. This reduction in fan speed can reduce overall noise of a fan, reduce energy consumption of the fan, and prolong the life of the fan.

EXAMPLE 2

Figure 7:
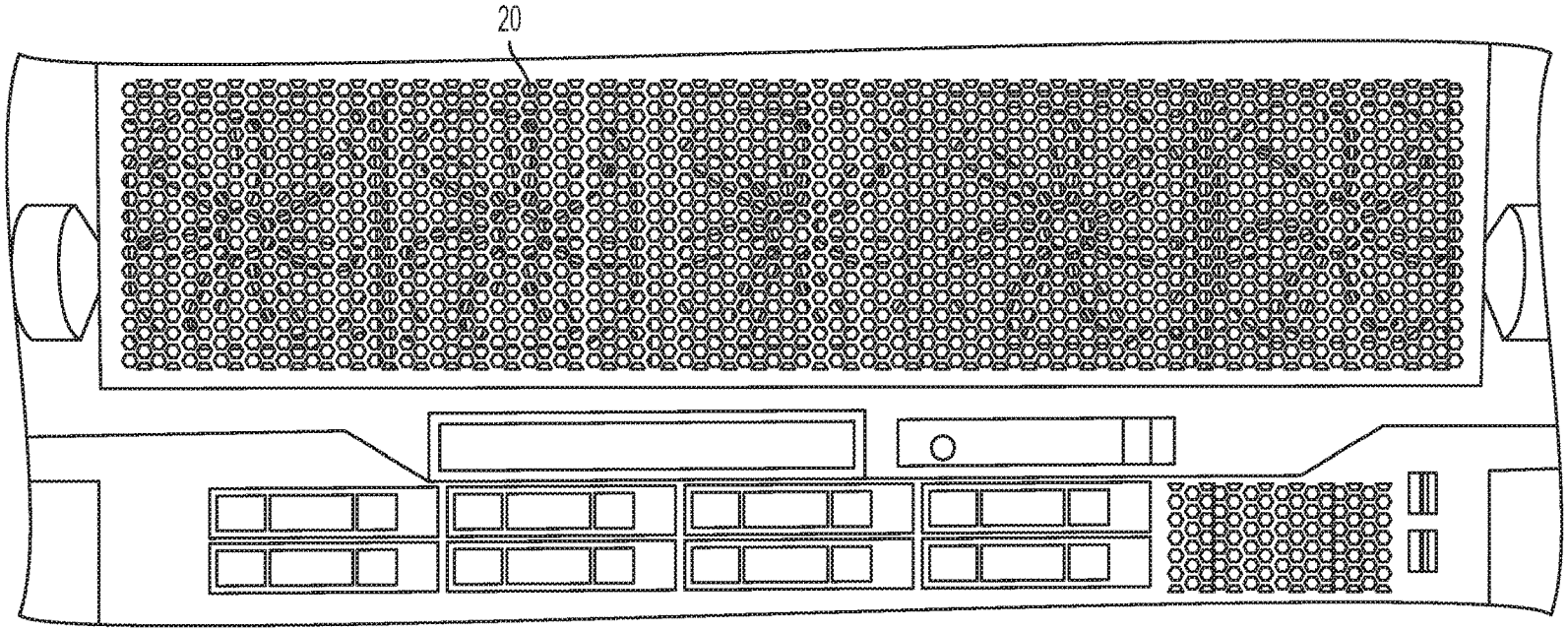
FIG. 7 is a front view of a product containing multiple fan assemblies that sit behind a bezel that can be used in conjunction with the fan guards of the present disclosure.

A front view of five individual fan assemblies, which can be used in conjunction with the fan guards described above, is shown in FIG. 7. In FIG. 7, a bezel 20 (honeycomb structure) is shown as covering five fan assemblies and separates the fan blades of each fan assembly from where the user can access the covered fan blades. With the bezel 20 installed, the fan guard would be in the state shown in FIG. 3. Upon removal of the bezel 20, a switch (not shown in FIG. 7, but included in the diagram of FIG. 6) can activate the first solenoid 6 and the second solenoid 10 as discussed above resulting in the fan guard being placed in the state shown in FIG. 1.

Figure 8:
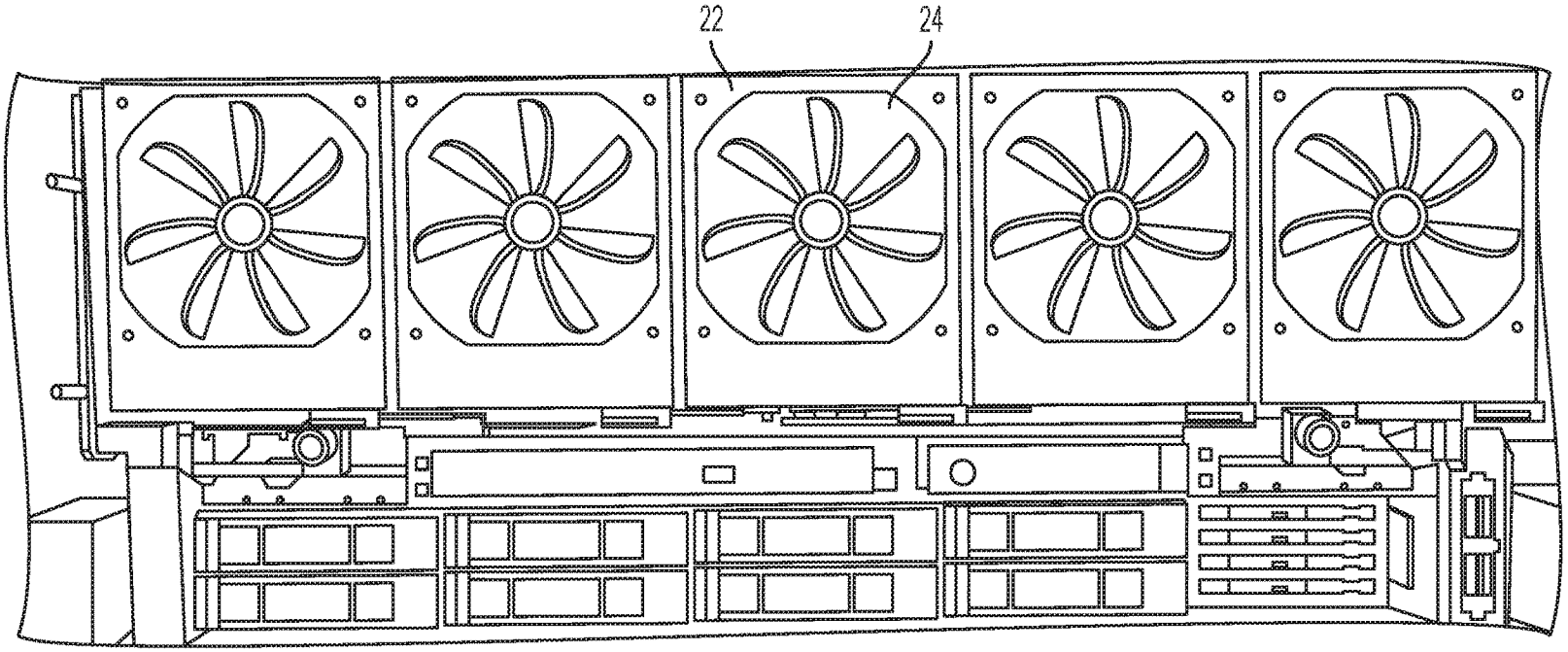
FIG. 8 is a front view of a product containing multiple fan assemblies with a removed bezel that can be used in conjunction with the fan guards of the present disclosure.

A front view of the five individual fan assemblies of FIG. 7 are shown again in FIG. 8, with the bezel 20 removed. In this view each fan assembly includes a barrier 22, which is between where the user can access and the fan blades 24. In embodiments of the present disclosure, each of these barriers 22 can be removed and replaced with the fan guard 1 described above.

While the present application has been particularly shown and described with respect to preferred embodiments thereof, it will be understood by those skilled in the art that the foregoing and other changes in forms and details may be made without departing from the spirit and scope of the present application. It is therefore intended that the present application not be limited to the exact forms and details described and illustrated, but fall within the scope of the appended claims.

What is claimed is:

1. A fan guard comprising:

a first lattice;

a second lattice;

a first solenoid operably connected to the second lattice, wherein the first solenoid is configured to move the second lattice relative to the first lattice from a first position to an alternate position; and a second solenoid, the second solenoid configured to extend through a portion of the first lattice when the second lattice is in the alternate position.

2. The fan guard of claim 1, wherein the first solenoid is configured to move the second lattice in one of a horizontal distance and a vertical distance between the first position to the alternate position.

3. The fan guard of claim 1, wherein the second solenoid prevents the second lattice from moving from the alternate position to the first position.

4. The fan guard of claim 1, wherein the second solenoid contacts a side of the second lattice in the alternate position.

5. The fan guard of claim 1, wherein the second solenoid is substantially perpendicular to both first lattice and second lattice.

6. The fan guard of claim 1, wherein the first solenoid is substantially parallel to both first lattice and second lattice.

7. The fan guard of claim 1, wherein crosspieces of the first lattice substantially align with crosspieces of the second lattice when the second lattice is in the first position.

8. The fan guard of claim 1, wherein when the second lattice is in the first position, openings between crosspieces of the first lattice and openings between crosspieces of the second lattice are larger than the area proscribed in IEC 60950.

9. The fan guard of claim 1, wherein when the second lattice is in the alternate position, openings between crosspieces of the first lattice and openings between crosspieces of the second lattice are smaller than or equal to the area proscribed in IEC 60950.

10. The fan guard of claim 1, wherein at least one of the first solenoid and the second solenoid is electrically connected to at least one delayed relay.

11. The fan guard of claim 1, further comprising a switch, the switch electrically connected to the first solenoid and the second solenoid.

12. The fan guard of claim 11, further comprising one or more additional solenoids electrically connected to the switch.

13. A method of operating a fan guard, the method comprising: moving a second lattice relative to a first lattice, wherein a first solenoid is operably connected to the second lattice, wherein the first solenoid is configured to move the second lattice relative to the first lattice from a first position to an alternate position; and extending a portion of a second solenoid through a portion of the first lattice.

14. The method of claim 13, wherein the second solenoid extends a predetermined amount of time after the first solenoid moves the second lattice to the alternate position.

15. The method of claim 13, further comprising the step of withdrawing the portion of the second solenoid from the portion of the first lattice.

16. The method of claim 15, further comprising the step of the first solenoid moving the second lattice from the alternate position to the first position.

17. The method of claim 16, wherein the first solenoid moves the second lattice a predetermined amount of time after the portion of the second solenoid is withdrawn from the portion of the first lattice.

18. The method of claim 13, wherein the first solenoid moves the second lattice to the alternate position upon detection of the stopping of rotation of a shaft of the fan.

* * * * *